US005242777A

United States Patent [19]

Kato et al.

[11] Patent Number: 5,242,777

[45] Date of Patent: Sep. 7, 1993

[54] TONER BINDER FOR ELECTROPHOTOGRAPHY

[75] Inventors: Tomohisa Kato; Shigeo Ochiai; Takashi Niinae, all of Kyoto, Japan

[73] Assignee: Sanyo Chemical Ind., Ltd., Kyoto, Japan

[21] Appl. No.: 796,637

[22] Filed: Nov. 22, 1991

[30] Foreign Application Priority Data

Nov. 29, 1990 [JP] Japan ..... 2-336432

[51] Int. Cl.[5] ..... G03G 9/087

[52] U.S. Cl. ..... 430/109; 430/110; 430/111

[58] Field of Search ..... 430/109, 110, 111

[56] References Cited

U.S. PATENT DOCUMENTS

| | | | |
|---|---|---|---|
| 3,941,898 | 3/1976 | Sadamatsu et al. | 430/109 X |
| 4,499,168 | 2/1985 | Mitsuhashi | 430/99 |
| 4,499,168 | 2/1985 | Mitsuhashi | 430/99 |
| 4,518,673 | 5/1985 | Noguchi et al. | 430/108 |
| 4,908,290 | 3/1990 | Watanabe et al. | 430/109 |
| 4,968,574 | 11/1990 | Morita et al. | 430/111 X |
| 4,973,538 | 11/1990 | Suzuki et al. | 430/111 X |

FOREIGN PATENT DOCUMENTS

| | | | |
|---|---|---|---|
| 0344308 | 11/1987 | European Pat. Off. . | |
| 0412712 | 7/1990 | European Pat. Off. . | |
| 158340 | 12/1981 | Japan | 430/111 |
| 22248 | 2/1982 | Japan | 430/111 |
| 7434 | 1/1985 | Japan | 430/111 |
| 60-45259 | 3/1985 | Japan . | |
| 60-20411 | 5/1985 | Japan . | |
| 244956 | 12/1985 | Japan | 430/111 |
| 61-215558 | 9/1986 | Japan . | |
| 127254 | 5/1988 | Japan | 430/111 |
| 2017949 | 10/1979 | United Kingdom | 430/111 |
| 2078385 | 5/1981 | United Kingdom . | |
| 2159970 | 4/1985 | United Kingdom . | |

*Primary Examiner*—Roland Martin

*Attorney, Agent, or Firm*—Birch, Stewart, Kolasch & Birch

[57] ABSTRACT

A toner binder for electrophotography is provided whose minimum fixing temperature is low, image offsetting temperature to the heat-roll is high, and whose stability upon storage is good.

The toner binder comprises a thermoplastic resin (I) of 10 to 50% by weight, i.e., a copolymer having a structural unit consisting of a styrene series monomer and a (meth)acrylic monomer, having a molecular weight of more than 30,000 when fractionated by gel permeation chromatography, having a glass transition temperature of −20° to +40° C.; and a thermoplastic resin (II) of 10 to 50% by weight, i.e., a polymer selected from a copolymer (II-a) of a vinyl monomer selected from group consisting of styrene and substituted styrenes, a copolymer (II-b) having a structural unit consisting of styrene series monomers and (meth)acrylic monomers, polyester resin (II-c), and a copolymer (II-d) including a moiety of a copolymer (II-b) and a moiety of a polyester resin (II-c). The toner binder has a molecular weight up to 30,000 when fractionated by gel permeation chromatography, and a glass transition temperature of 50° to 100° C. These thermoplastic resins are blended to exhibit a difference of 25° to 100° C. between the respective glass transition temperatures thereof.

57 Claims, No Drawings

TONER BINDER FOR ELECTROPHOTOGRAPHY

BACKGROUND OF THE INVENTION

1. Field of the Invention

The present invention relates to an improved binder applied to a toner for electrophotography. More particularly, the present invention relates to a resin composition of a binder for electrophotographic toners which is capable of being used with a heat-roll fixing method.

2. Description of the Prior Art

In electrophotography, the heat-roll fixing method has been widely used to fix electrostatic latent images to be visualized with a developing toner. The toner used for this method is required to have the following characteristics: The minimum fixing temperature (abbreviated MF hereinafter) is low. Secondly, the image-offsetting temperature of the heat-roll is high. Thirdly, stability of the toner in storage is good, i.e., powders of the toner are not easily coagulated.

Japanese Pat. Publication No. 60-20411 and Japanese Pat. Tokkai Sho No. 61-215558 disclose an invention wherein a binder that possesses a wide range of molecular weight distribution over from a low molecular weight to a high molecular weight, and whose glass transition temperature is 5° to 80° C., is applied to a toner to meet the above mentioned three requirements. Also Japanese Pat. Tokkai Sho No. 60-45259 discloses a toner binder wherein a copolymer of a styrene series monomer and (meth)acrylic ester (hereinafter, the meaning of (meth)acryl- is not specified as either acryl- or methacryl-) is divided into three fractions at the boundaries of molecular weight 100,000 and 200,000 by employing gel permeation chromatography, and a certain amount of the obtained component possessing a glass transition temperature in a certain range is mixed, respectively. Further U.S. Pat. No. 4,499,168 discloses a toner binder consisting of a styrene-(meth)acrylate copolymer (A) having its molecular peak at 5,000 to 80,000, and a styrene-(meth)acrylate copolymer (B) having its molecular peak at 100,000 to 2,000,000 when both of these copolymers being are fractionated by gel permeation chromatography. The mixing proportion of copolymers A:B is in a weight ratio of 2:1 to 1:50.

However, with a progress of high-speed copying by electrophotography, a toner in which the MF value is lower than that of conventional toners besides the HO value is not lower has been recently required. However, toners comprising conventional binders possess the drawback that a lower MF value causes lower a HO value and poor stability in storage, and conversely, a higher HO value and good stability in storage cause the MF value to be higher. Japanese Pat. Tokkai Sho No. 60-45259, for example, discloses a toner binder consisting of 20 to 30 weight % of styrene-(meth)acrylate copolymers having a glass transition temperature between 35 and 50° C.; 5 to 15 weight % of styrene-(meth)acrylate copolymers having a glass transition temperature between 35° and 60° C.; and 60 to 70 weight % of styrene-(meth)acrylate copolymers having a glass transition temperature between 50° and 100° C. Since the toner employing this binder has a low MF value but possesses a high HO value, and poor stability upon storage, it is difficult to employ this toner for recent high-speed copying purposes.

Therefore, an object of the present invention is to provide a toner binder for electrophotography which may be followed employed in high-speed of of copying by electrophotography.

In other words, an object of the present invention is to provide a binder capable of providing a toner possessing a low MF value, a high HO value, and good stability upon storage which is used for electrophotography.

SUMMARY OF THE INVENTION

The binder which is applied to the toner for electrophotography according to the present invention consisting essentially of: 10 to 50 weight % of the total weight of the binder of a thermoplastic resin (I) having a molecular weight of at least 30,000 when fractionated by gel permeation chromatography, having a glass transition temperature of −20° to +40° C., and a copolymer (referred to as a copolymer (I-a) hereinafter) having a structural unit including a styrene series monomer and a (meth)acrylic monomer; and 50 to 90 weight % of the total weight of the binder of a thermoplastic resin (II) having a molecular weight less than 30,000, with a glass transition temperature of +50° to +100° C.; and a polymer selected from the group consisting of, a (co)polymer (to be referred to as copolymer (II-a) hereinafter; the meaning of (co)polymer is not specified as either a homopolymer or a copolymer) of a vinyl monomer selected from the group consisting of styrene and substituted styrene, a copolymer (referred to as a copolymer (II-b) hereinafter) having a structural unit consisting of a styrene series monomer and a (meth)acrylic monomer, a polyester resin (referred to as a polyester resin (II-c) hereinafter), and a copolymer (referred to as a copolymer (II-d) hereinafter) containing a copolymer (II-b) moiety and a polyester resin (II-c) moiety.

The thermoplastic resin (I) and the thermoplastic resin (II) exhibit a difference in glass transition temperature between 25° and 100° C.

All weight % herein indicate percentage of the total weight of the thermoplastic resin (I) and (II), which are the toner binders.

DETAILED DESCRIPTION OF THE INVENTION

The binder of the present invention is described hereafter in detail.

First, the thermoplastic resin (I) which may be employed in the present invention is described.

The styrene series monomer which is one of the structural units of the previously mentioned copolymer (1-a) may include styrene and substituted styrenes, such as alkyl group substituted styrenes, and halogen substituted styrenes. Alkyl group substituted styrenes include, for example, α-methyl styrene, p-methyl styrene and the like. Among these monomers, styrene is preferred.

Another structural unit of the copolymer (I-a), (meth)acrylic monomer includes acrylic acid, methacrylic acid, acrylonitrile, methacrylonitrile, acrylic acid esters and methacrylic acid esters which are derived from alcohols having one to eighteen carbon atoms. These foregoing alcohols may contain a substituent group such as a hydroxyl group or an amino group. Acrylic esters and methacrylic esters which are derived from alcohols having one to eighteen carbon atoms include: methyl (meth)acrylate, ethyl (meth)acrylate, butyl (meth)acrylate, 2-ethylhexyl (meth)acrylate, lauryl (meth)acrylate, stearyl (meth)acrylate, and the like; (meth)-acrylates containing a hydroxyl group, such as hydroxylethyl (meth)acrylate; and (meth)acrylates containing amino group, such as dimethylaminoethyl (meth)acrylate and diethylaminoethyl (meth)acrylate.

Among these, preferred are (meth)acrylic acid and its esters, typically, methyl (meth)acrylate, ethyl (meth)acrylate, butyl (meth)acrylate, 2-ethylhexyl (meth)acrylate, and a mixture of (meth)acrylic acids and the foregoing (meth)acrylates.

Besides the above-mentioned monomers, vinyl esters, aliphatic hydrocarbon series vinyl monomers and multifunctional monomers having at least two or more double bonds which are capable of radical polymerization may be used as a monomer of copolymer (I-a). In general, monomers containing one vinyl group not exceeding 30 weight % of copolymer (I-a) may be used. As for multifunctional monomers containing at least two or more double bonds, less than 1 weight % of such multifunctional monmers of copolymer (I-a) may be used.

Said vinyl ester includes vinyl acetate and vinyl propionate, and said aliphatic hydrocarbon vinyl monomer includes butadiene and the like. The multifunctional monomers include such aromatic multifunctional monomers as divinyl benzene, and such aliphatic multifunctional monomers as ethylene glycol diacrylate, 1,6-hexanediol diacrylate, and the like.

The copolymer (I-a) may be produced by solution polymerization, bulk polymerization, suspension polymerization or emulsion polymerization. To polymerize monomers, initiators may be employed.

Subsequently, the thermoplastic resin (II) in the present invention is described.

Substituted styrenes which are used for (co) polymer (II-a) are the same substituted styrenes used for copolymer (I-a). Among these monomers, styrene is preferred.

Monomers which are used for copolymer (II-b) are the same monomers mentioned in description of the copolymer (I-a). However, the monomers which are used herein are monomers wherein the types and proportions of the monomers are proper for the copolymer (II-b) to have a glass transition temperature between 50° and 100° C. Preferred is the copolymer of styrene and (meth)acrylatic ester.

The polyester resins (II-c) which are employed herein are derivatives of dicarboxylic acids or their anhydrides having two to thirty carbon atoms and diols having two to thirty carbon atoms. The dicarboxylic acids their anhydrides and the diols may be selected from either aliphatic compounds or aromatic compounds. The dicarboxylic acids and their anhydrides include aromatic carboxylic acids such as terephthalic acid, for example, isophthalic acid, phthalic acid, and phthalic anhydride; aliphatic carboxylic acids and their anhydrides such as fumaric acid, maleic acid, maleic anhydride, and the like. The diols include bisphenol A ethylene oxide adduct, bisphenol A propylene oxide adduct, ethylene glycol, propylene glycol, and neopentyl glycol. Preferred is a polyester resin containing an aromatic group therein, and this aromatic group may be either on the dicarboxyl molecule or on the diol molecule. More preferred is a polyester resin having a bisphenol structure.

The polyester resin (II-c) may be produced by using a catalyst such as dibutyltin oxide, stannous oxide, or tetrabutyl titanate, if necessary. Esterification may conventionally be carried out under conditions of atmospheric pressure or reduced pressure, in the presence or absence of inert gas or solvents such as toluene, xylene, etc., at a temperature of 150° to 250° C.

Moreover, the copolymer (II-d) having moiety of a copolymer (II-b) and moiety of a polyester resin (II-c) allows the moiety to be either straight chain or branched. The copolymer (II-d) may be produced by either addition polymerization or condensation polymerization.

The copolymer (II-d) may include: (1) a condensation polymer of a copolymer moiety containing a carboxyl group composed of a styrene series monomer and a (meth)acrylic monomer; and a polyester resin (II-c) moiety containing a hydroxyl group therein. (2) a condensation polymer of a copolymer moiety containing a hydroxyl group composed of a styrene series monomer and a (meth)acrylic monomer; and a polyester resin (II-c) moiety containing a carboxyl group therein. (3) an addition polymer of a polyester resin (II-c) having a radical polymerizable group; and a monomer in order to form a copolymer (II-a) moiety whose structural unit includes a styrene series monomer and a (meth)acrylic monomer. Among these mentioned above, preferred is a graft-copolymer of the polyester resin (II-c) having a radical polymerizable groups, and a monomer to compose the copolymer (II-a) moiety whose structural unit includes a styrene series monomer and a (meth)acrylic monomer. The constituents of the copolymer (II-d) may employ the same constituents which are used for the copolymer (I-a), the copolymer (II-b), and the polyester resin (II-c).

The thermoplastic resin (II) of the present invention including the (co)polymer (II-a), the copolymer (II-b), the polyester resin (II-c) and the copolymer (II-d) may be used alone or a combination of two or more polymers. In case of the combined use of the copolymer (II-b), the polyester resin (II-c) and the copolymer (II-d), the thermoplastic resin (II) may be obtained by producing the respective polymers separately, and blending these polymers in a solution or in a molten state. Also, the thermoplastic resin(II) may be obtained by preparing some polymer of those polymers in situ another polymer.

Gel permeation chromatography, which is used to fractionate the thermoplastic resin (I) and the thermoplastic resin (II) which are used for the binder of the present invention and to determine their molecular weights, employs such conventional methods and equipment as are used in the examples. Measurement of glass transition temperatures also employs conventional methods.

In the binder of the present invention, the thermoplastic resin (I) which is fractionated by gel permeation chromatography and usually has a molecular weight of at least 30,000 and not exceeding 20,000,000, preferably not exceeding 10,000,000 and more preferably not exceeding 5,000,000, can be present in an amount between 10 to 50 weight %, and preferrably 15 to 45 weight %, based on the total weight. The thermoplastic resin (II) having a molecular weight between 150 to 30,000, preferably 250 to 30,000, and more preferably 500 to 30,000, 50 to 90 weight %, and preferably 55 to 85 weight %, based on the total weight. When the amount of the thermoplastic resin (I) is less than 10 weight %, HO is decreased; when the thermoplastic resin (II) is less than 50 weight %, MF is increased, and the stability of a toner in storage is decreased.

It is an important factor that the difference in glass transition temperatures between the thermoplastic resin (II) and the thermoplastic resin (I) is in the range of 25 to 100° C. If the difference in glass transition temperatures is below 25° C., the MF will be elevated, and if the difference is over 100° C., the stability upon storage is decreased.

The glass transition temperature of the resin composition of the present invention is usually in the range of 40° to 70° C. When conventional binders having a glass transition temperature less than 50° C. are used for toners, the stability upon storage is not as great as desired; however, the binder of the present invention is not like that. That is, the thermoplastic resin (II), a low molecular weight (co)polymer, which is contained in the binder of the present invention, has a glass transition temperature above the usual temperature of preservation, facilitating long term stability upon storage of the toner comprising the resin composition. Even if the glass transition temperature of the binder of the present invention is 40° to 50° C., the toner does not coagulate over the long term and retains its the long term, stability in storage. On the other hand, the glass transition temperature of the thermoplastic resin (I) of high molecular weight copolymers is below the glass transtion temperature of conventional binders, and this is effective to decrease the temperature whereat the toner reaches the necessary viscosity for fixing.

The dynamic viscoelasticity of the binder of the present invention is the absolute value of the complex viscosity coefficient, which is referred to as $|\eta^*(140)|$ hereinafter. This is in the range of 1000 to 20,000 poise under the condition of a temperature of 140° C. and a frequency of 10 rad/sec. Under the same conditions, the storage modulus, which is referred to as G' (140) hereinafter, is in the range of 10,000 to 200,000 dyn/cm$^2$. Under the condition of a temperature of 240° C. a and frequency of 10 rad/sec the storage modulus, which is referred to as G' (240) hereinafter, is preferably between 100 and 4,000 dyn/cm$^2$.

It is desirable that the toner which is used for electrophotography have a low MF. Because the MF is low, the influence of heating by the heat roll in a duplicator on the toner will be small. For this purpose the binder used herein is required to tend to flow at low temperature, and likely to become in plastically deformed. The values of $|\eta^*(140)|$ and G' (140) in the binder are desired to be low.

The HO of the toner is preferred to be higher. The binder is required to be hard in plastic deformation at high temperature. For this purpose the G' (240) of the binder is desired to be larger.

However, if $|\eta^*(140)|$ of the binder is less than 1,000 poise and G' (140) is less than 10,000 dyn/cm$^2$, the HO value decreases and the binder will not withstand practical use. Also if G' (240) is more than 4,000 dyn/cm$^2$, it causes the MF to be high, and the binder will not withstand practical use. Also, if either $|\eta^*(140)|$ of the toner binder exceeds 20,000 poise or G' (140) exceeds 200,000 dyn/cm$^2$, this causes the MF to be increased; and if G' (240) is less than 100 dyn/cm$^2$, it causes the HO to be decreased, and the toner binder does not withstand practical use.

To the above-mentioned toner binder of the present invention a certain amount of polyolefin of low molecular weight (usually 1,000 to 50,000, preferably 3,000 to 40,000, weight average molecular weight) such as polyethylene or polypropylene may be added. However, the amount added addition are usually not more than 30 weight % to the binder. To add this polyolefin of low molecular weight, there are such methods as polymerizing the thermoplastic resin (I) or (II) in the presence of polyolefin of the low molecular weight, and adding the polyolefin of low molecular weight after polymerizing the thermoplastic resin (I) or (II).

The toner for electrophotography wherein the binder of the present invention is employed is usually the produced by using following materials: 50 to 95 weight % of the binders; 5 to 10 weight % of well-known colorants such as carbon black, iron black, benzidine yellow, quinacridone, rhodamine B, and phthalocyanine; 0 to 50 weight % of magnetic powder, such as ferromagnetic powder of iron, cobalt and nickel, or such compounds of magnetite, hematite, and the like; a toner charge regulation agent such as a metal complex, nigrosine, etc.; and additives of such a lubricants as like polytetrafluoroethylene, polyolefins of low molecular weight, fatty acids or their metal salts and its or amides may be added. Moreover, fine a powder of hydrophobic colloidal silica may be added in order to improve the fluidity of the toner. The amount of the above-mentioned additives is usually 0 to 5 weight % of total weight of the toner.

The above-mentioned toner wherein the binder of present invention is employed is usually prepared in the following way. After the binder, colorant, magnetic powder and additives are dry-blended, the blended powder is melted, kneaded, crushed, and finally milled as a fine powder by using a jet mill. The milled powder is classified, and powder wherein the particle size is in the range of 5 to 20 μm is used to produce the toner.

The thus obtained toner is blended, if necessary, with a carrier such as iron powder, glass bead nickel powder, or ferrite, and may be used as a developer for electrostatic latent images.

The toner which was obtained herein is capable of being fixed onto such materials as paper or polyester film by using a well-known heat-roll fixing method.

EXAMPLES

The present invention is further illustrated in detail in the following examples and comparative examples for producing the binder, and in the examination of the fixing test of the toner produced by using the binder which was obtained in the following examples. However, these examples are not intended to be limiting.

All parts in the examples herein are by weight unless otherwise specified. A molecular weight exceeding 30,000 fractionated by gel permeation chromatography herein refers to a molecular weight between 30,000 and 10,000,000; a molecular weight below 30,000 herein refers to a molecular weight between 3,000 and 30,000.

Further, in the following examples and comparative examples, the measurements of characteristic values were conducted employing the following equipment and conditions:

a) Weight-average molecular weight measured with gel permeation chromatography.

Equipment: HLC-802A made by TOSOH CORPORATION (JAPAN)

Column: 2 columns of TSK gel GMH6 (Made by TOSOH CORPORATION LTD.)

Temperature: 40° C.

Sample solution: 0.5 weight % of THF solution

Applied volume: 200 μl

Detector: Refractive detector cf: Molecular weight standard curve is generated with standard polystyrene.

b) Measurement of dynamic viscoelasticity

Equipment: RDS-7700 II Dynamic Spectrometer made by RHEOMETRICS Inc. (U.S.A.)
Test Fixture: 25 mmϕ Parallel plate
Temperature: 140° C., 240° C.
Frequency: 10 rad/sec c) Measurement of Glass Transition Temperature (Tg)

Equipment: DSC 20, SSC/580 Made by SEIKO ELECTRONIC CO. LTD., (JAPAN).
Condition: Follow to ASTM (D3418-2)

In the following examples, the equipment and the conditions employed in the gel permeation chromatography to fractionate the thermoplastic resing (I) and (II) which are contained in the binder are as follows.

Equipment: LC-09, Made by NIHON BUNSEKI KOGYO Co., Japan.
Column: LS-255
Sample solution: 1.5 weight % chloroform solution
Applied volume: 10 ml
Detector: RI Detector
Fractionation point: The retention time corresponding to the molecular weight 30,000 was calculated with standard polystyrene. This retention time indicates a partition point of the sample.

EXAMPLE 1

To a four-necked flask of 1 liter, 1,400 parts of water and 150 parts of 2 weight % solution of a polyvinyl alcohol (PVA235, made by KURARAY Co., LTD., Japan) were added, then to the solution a mixture composed of 600 parts of styrene, 400 parts of n-butyl acrylate and 1 part of 1,1-di-t-butylperoxy-3,3,5-trimethyl cyclohexanone were added, and there was obtained a suspension after stirring the solution. Next, after the inner atmosphere of the flask was replaced sufficiently with nitrogen, raising the temperature up to 90° C. initiated the polymerization. The polymerization was continued keeping the temperature at 90° C. Then, the conversion was confirmed to reach 98% after 14 hours, and the temperature was raised up to 95° C. The suspension polymerization was completed 2 hours after the confirmation. The thus obtained suspension was filtered, washed with water, and dried, and then the polymer was obtained. This polymer was referred to as A-1.

Separately, 900 parts of xylene were poured into a 2 liter stainless steel autoclave. After the inner atmosphere of the autoclave was replaced sufficiently with nitrogen, the poured xylene was heated up to 200° C. under in a closed state. A mixture of 1000 parts of styrene and 17 parts of di-t-butyl peroxide was dropped into the reaction solution at this temperature for 3 hours, and the polymerization was finished after 2 hours retention. Then the obtained polymer solution was cooled down to 140° C. This polymer solution was referred to as B-1.

To 1235 parts of the polymer solution B-1 was added 350 parts of the polymer A-1, and after the solution was heated for 4 hours with refluxing xylene, binder C-1 of the present invention was obtained by evaporating the xylene.

The glass transition temperature of the binder C-1 was 52° C., and its weight average molecular weight was 190,000. In the binder C-1, the content of the thermoplastic resin (I), which was fractionated by gel permeation chromatography, and the molecular weight of which exceeded 30,000, was 35 weight % and its glass transition temperature was 35° C. The content of the thermoplastic resin (II), of which was below 30,000, was 65 weight % and its glass transition temperature was 68° C. The $|\eta^*(140)|$ of C-1 was 10,000 poise, G'(140) was 80,000 dyn/cm$^2$, and G'(240) was 1,200 dyn/cm$^2$.

EXAMPLE 2

The procedure of Example 1 was repeated under the same conditions employing the same materials except for the amount of materials used for polymer A-1. The amount of styrene was altered to 550 parts, the amount of n-butyl acrylate was altered to 450 parts, and thus polymer A-2 was obtained. Further, using the thus the obtained polymer A-2, the procedure of Example 1 was repeated, and binder C-2 was obtained.

The glass transition temperature of the binder C-2 was 48° C. and its weight average molecular weight was 160,000. Among these products, the content of the thermoplastic resin (I) which was fractionated by gel permeation chromatography and having a molecular weight exceeding 30,000 was 35 weight %, and its glass transition temperature was 23° C. The content of the thermoplastic resin (II) the molecular of which was below 30,000 was 65 weight %, and its glass transition temperature was 68° C. The $|\eta^*(140)|$ of C-2 was 2,100 poise, G'(140) was 95,000 dyn/cm$^2$, and G'(240) was 3,000 dyn/cm$^2$.

EXAMPLE 3

The procedure of Example 1 was repeated under the same conditions and same materials except for the amount of materials used for polymer A-1. The amount of styrene was altered to 450 parts, the amount of n-butyl acrylate was altered to 550 parts, and then polymer A-3 was obtained. Further, using the thus obtained polymer A-3, the procedure of Example 1 was repeated and a binder C-3 was obtained.

The glass transition temperature of the binder C-3 was 45° C. and its weight average molecular weight was 180,000. Among these products, the content of the thermoplastic resin (I) which was fractionated by gel permeation chromatography and having a molecular weight exceeding 30,000 was 35 weight %, and its glass transition temperature was 12° C. The content of the thermoplastic resin (II) the molecular weight of which was below 30,000 was 65 weight %, and its glass transition temperature was 68° C. The $|\eta^*(140)|$ of C-3 was 2,000 poise, G'(140) was 60,000 dyn/ cm$^2$, and G'(240) was 1,800 dyn/cm$^2$.

EXAMPLE 4

The procedure of Example 1 was repeated herein under the same conditions and using the same materials except for the amount of the materials used for the polymer A-1. The amount of styrene was altered to 600 parts, the amount of n-butyl acrylate was altered to 400 parts, and polymer A-4 was obtained. Further, among the materials which were used for the polymer solution B-1, the amount of styrene was altered to 850 parts, and 150 parts of n-butyl acrylate were added, wherein other materials and conditions were the same as in Example 1, polymer solution B-2 was obtained. Using the thus obtained polymer A-4 and the polymer solution B-2, the procedure of Example 1 was repeated, and binder C-4 was obtained.

The glass transition temperature of the binder C-4 44° C., and its weight average molecular weight was 190,000. Among these products, the content of the thermoplastic resin (I) which was fractionated by gel permeation chromatography and having a molecular weight exceeding 30,000 was 35 weight %, and its glass transition temperature was 32° C. The content of the thermoplastic resin (II) the molecular weight of which was below 30,000 was 65 weight %, and its glass transition temperature was 60° C. The $|\eta^*(140)|$ of C-4 was 11,300 poise, G'(140) was 53,900 dyn/cm$^2$, and G'(240) was 730 dyn/cm$^2$.

EXAMPLE 5

The procedure of Example 1 was repeated under the same conditions and use of the same material, except for the amount of the materials used for polymer A-1. The amount of styrene was altered to 300 parts, the amount of n-butyl acrylate was altered to 700 parts, and polymer A-5 was obtained. Further, among the materials used for the polymer solution B-1, 1000 parts of styrene were replaced with 500 parts of styrene, 50 parts of $\alpha$-methyl styrene and 450 parts of methyl methacrylate. The procedure in Example 1 was repeated, and polymer solution B-3 was obtained. Using 200 parts of the obtained polymer A-5 and 1520 parts of the polymer solution B-3, the procedures of Example 1 were repeated, and binder C-5 was obtained.

The glass transition temperature of the binder C-5 was 58° C., and its weight average molecular weight was 140,000. Among these products, the content of the thermoplastic resin (I) which was fractionaed by gel permeation chromatography and having a molecular weight exceeding 30,000 was 20 weight %, and its glass transition temperature was −18° C. The content of the thermoplastic resin (II) the molecular weight of which was below 30,000 was 80 weight %, and its glass transition temperature was 80° C. The $|\eta^*(140)|$ of C-5 was 1,300 poise, G' (140) was 12,000 dyn/cm$^2$, and G' (240) was 120 dyn/cm$^2$.

EXAMPLE 6

The procedure of Example 1 was repeated under the same condition and the use of the same materials except for the amount of the materials used for the polymer A-1. The amount of styrene was altered to 550 parts, the amount of n-butyl acrylate was altered to 450 parts, and polymer A-6 was obtained. Further, among the materials used for the polymer solution B-1, 1000 parts of styrene were replaced with 500 parts of styrene and 500 parts of methyl methacrylate. The procedure of Example 1 was repeated, and polymer solution B-4 was obtained. Using the obtained polymer A-6 and the polymer solution B-4, the procedures of Example 1 were repeated, and binder C-6 was obtained.

The glass transition temperature of the binder C-6 was 52° C., and its weight average molecular weight was 170,000. Among these products, the contents of the thermoplastic resin (I) which was fractionated by gel permeation chromatography and having a molecular weight exceeding 30,000 was 35 weight %, and its glass transition temperature was 23° C. The content of the thermoplastic resin (II) the molecular weight of which was below 30,000 was 65 weight %, and its glass transition temperature was 70° C. The $|\eta^*(140)|$ of C-6 was 9,000 poise, G'(140) was 70,000 dyn/cm$^2$, and G'(240) was 1,400 dyn/cm$^2$.

EXAMPLE 7

Into a four necked flask of 1 liter, 279 parts of phthalic anhydride, 787 parts of 2 mol ethylene oxide addition compound of bisphenol A, and 2 parts of dibutyltin oxide were poured. After the inner atmosphere of the flask was replaced with nitrogen, the thus prepared mixture was heated up to 230° C. Further, the mixture was dehydrated at a temperature of 230° C. for 25 hours and was dehydrated again under a reduced pressure of less than 15 mmHg for 10 hours. There was then obtained a polyester, referred to as P-1. The acid value of P-1 herein was 2.

Separately, 310 parts of P-1 and 2 parts of maleic anhydride were poured into a 2 liter stainless steel autoclave. After the inner atmosphere of the autoclave was sufficiently replaced with nitrogen, the prepared mixture was heated up to 170° C., and kept stirring for 3 hours. Then the stirred mixture was cooled down to 140° C., 900 parts of xylene were added and the mixture heated up to at a temperature of 205° C. in a closed state. Subsequently, a mixture of 580 parts of styrene and 110 parts of n-butyl acrylate was added dropwise to the reaction solution for 9 hours. After the completion of the polymerization by keeping the reaction solution for 3 hours, the reaction solution was cooled down to 140° C. This polymer solution was referred to as B-5.

After a mixture of 200 parts of the polymer A-2 and 1520 parts of the polymer solution B-5 was heated for 4 hours with refluxing xylene, there was obtained C-7 of the present invention by evaporating away the xylene.

The glass transition temperature of the binder C-7 was 46° C., and its weight average molecular weight was 110,000. Among these, the content of the thermoplastic resin (I) which was fractionated by gel permeation chromatography and having a molecular weight exceeding 30,000 was 30 weight %, and its glass transition temperature was 23° C. The content of the thermoplastic resin (II) the molecular weight of which was below 30,000 was 70 weight %, The its glass transition temperature was 60° C. And $|\eta^*(140)|$ of C-7 was 1,500 poise, G'(140) was 46,000 dyn/cm$^2$, and G'(240) was 1,300 dyn/cm$^2$.

COMPARATIVE EXAMPLE 1

A polymer A-7 was obtained via a reaction wherein the materials and conditions were kept the same as in the preparation of polymer A-5 in Example 5, except the amount of styrene was altered to 200 parts and the amount of n-butyl acrylate was altered to 800 parts. Further, a binder C-8 was obtained via a reaction the same as in Example 5 except using 150 parts of the polymer A-7 and 1615 parts of the polymer solution B-3.

The glass transition temperature of the binder C-8 was 62° C., and its weight average molecular weight was 150,000. Between them the content of the thermoplastic resin (I) which was fractionated via gel permeation chromatography and having a molecular weight exceeding 30,000 was 15 weight %, and its glass transition temperature was −28° C. The the content of the thermoplastic resin (II) having molecular weight below 30,000 was 85 weight %, and its glass transition temperature was 80° C. The $|\eta^*(140)|$ of C-8 was 1,000 poise, and G'(140) was 70,000 dyn/cm$^2$, G'(240) was 80 dyn/cm$^2$.

COMPARATIVE EXAMPLE 2

A polymer A-8 was obtained via a reaction wherein the materials and reaction conditions were kept the same as in the preparation of polymer A-1 in Example 1, except that the amount of styrene was altered to 650 parts and the amount of n-butyl acrylate was altered to 350 parts. Further, a polymer solution B-6 was obtained via a reaction wherein the materials and the reaction conditions were kept the same as in the preparation of the polymer solution B-1 in Example 1, except that the amount of styrene was altered to 900 parts and the amount of n-butyl acrylate was altered to 100 parts. Then there was obtained a binder C-9 via a reaction the same as in Example 1, except using A-8 and B-6.

The glass transition temperature the binder C-9 was 50° C., and its weight average of molecular weight was 160,000. Between them the content of the thermoplastic resin (I) which was fractionated via gel permeation chromatography and having a molecular weight exceededing 30,000 was 50 weight %, and its glass transition temperature was 43° C. The the contents of the thermoplastic resin (II) having a molecular weight below 30,000 was 50 weight %, and its glass transition temperature was 54° C. The $|\eta^*(140)|$ of C-9 was 4,000 poise, G'(140) was 210,000 dyn/cm$^2$, and G'(240) was 8,000 dyn/cm$^2$.

COMPARATIVE EXAMPLE 3

To a water medium wherein 25 parts of tricalcium phosphate, 0.6 parts of sodium dodecylbenzene sulfonate and 0.3 parts of sodium chloride were added into 940 parts of water, a solution which was composed of 800 parts of styrene, 200 parts of n-butyl acrylate and 26 parts of benzoyl peroxide was added, and then suspension polymerization was carried out at 90° C. for 5 hours. After the completion of polymerization, the resultant product was filtered, dried and referred to as a copolymer CP-1.

A copolymer was obtained using the same materials and the same conditions as in the production of CP-1, except that the amount of benzoyl peroxide was altered to 42 parts. The obtained copolymer was referred to as CP-2.

Further, a copolymer was obtained under the same conditions, except that the amount of styrene was altered to 750 parts, the amount of n-butylacrylate was altered to 250 pars, and the amount of benzoyl peroxide altered to 7.6 parts. The obtained polymer was referred to as CP-3.

To a water medium wherein 160 parts of a 5% solution of polyvinyl alcohol, 8 parts of sodium dodecylsulfate, and 8 parts of sodium persulfate were dissolved in 1024 parts of water, a solution composed of 560 parts of styrene, 240 parts of n-butyl acrylate, and 0.08 parts of divinyl benzene was added, and the solution was reacted at a temperature of 90° C. for 6 hours. During the reaction, the solution changed phase from emulsion to suspension. After polymerization was completed, the obtained product was filtered, dried and referred to as copolymer CP-4.

To 600 parts of xylene, subsequently, 190 parts of CP-1, 430 parts of CP-2, 100 parts of CP-3, and 280 parts of CP-4 were added, and the thus prepared mixture was heated for 4 hours with refluxing xylene. After evaporating the xylene, a binder C-10 was obtained.

The glass transition tempereture of the binder C-10 was 50° C., and its weight average molecular weight was 140,000. In the binder C-10, the content of the thermoplastic resin (I) which was fractionated via gel permeation chromatography and having a molecular weight exceeding 30,00 was 40 weight %, and its glass transition temperature was 45° C. The content of the thermoplastic resin (II) having a molecular weight below 30,000 was 60 weight %, and its glass transition temperature was 57° C. The $|\eta^*(140)|$ of C-10 was 1,900 poise, and G'(140) was 900 dyn/cm$^2$, G'(240) was 90 dyn/cm$^2$.

EVALUATION

The binders C-1 to C-7 of the present invention which were obtained in Example 1 to 7, and the binders C-8 to C-10 which were obtained in Comparative Examples 1 to 3, were herein employed respectively to prepare toners, and the prepared toners were used in a duplicator and evaluated.

Namely, 88 parts of the sample binders which were obtained in the above-mentioned examples and comparative examples were mixed respectively with 7 parts of carbon black (MA 100: MITUBISHI KASEI CORPORATION (JAPAN)), 3 parts of low molecular weight polypropylene (VISCOL 550P: SANYO CHEMICAL INDUSTRIES, LTD. (JAPAN), and 2 parts of charge regulator (SPILON BLACK TRH: HODOGAYA CHEMICAL CO., LTD. (JAPAN)) to make 100 parts. Each of these mixture was mixed uniformly, further mixed with a twine screw extruder the inner temperature of which was kept at 150° C., extruded and cooled, pulverized with a jet pulverizer, and graded with a dispersion separator. There were obtained toners of average particle size 12 μm.

Each of the obtained toners was numbered in numerical order as ① to ⑩ corresponding to the employed binders C-1 to C-10. Toners ① to ⑩ were evaluated respectively via the following tests. The results are shown in the tables.

TEST 1

3 parts of each of toner ① to toner ⑩ were added to 97 parts of ferrite carrier (EFV 200/300: NIPPON TEPPUN CORPORATION (JAPAN)), mixed uniformly, and subjected to the fixing test with a duplicator (BD-7720: TOSHIBA CORPORATION (Japan)). The results are shown in Table 1.

TABLE 1

| | Examples | | | | | | | Comparative Examples | | |
|---|---|---|---|---|---|---|---|---|---|---|
| Sample | ① | ② | ③ | ④ | ⑤ | ⑥ | ⑦ | ⑧ | ⑨ | ⑩ |
| MF (°C.) *1 | 135 | 130 | 130 | 135 | 130 | 130 | 130 | 130 | 150 | 130 |
| HO (°C.) *2 | >220 | >220 | >220 | >220 | >220 | >220 | >220 | 220 | >220 | 200 |

Remarks *1 MF is a heat roll temperature of a copy whose image density after rubbing remained more than 70% using the GAKUSHIN fastness tester (rubbing was applied on the paper surface), wherein rubbing was performed back and forth five times onto the solid image portion having an image density of 1.2.
Remarks *2 HO is a heat roll temperature whereat the toner was heat offsetting.

TEST 2

Several amounts of each toner were placed in a glass bottle. After being kept for 24 hours in a constant temperature bath set at 40° C., the storage stability test was carried out using a powder tester (HOSOKAWA MICRON CORPORATION (Japan)). The results are shown in Table 2.

TABLE 2

| Sample | Examples | | | | | | | Comparative Examples | | |
|---|---|---|---|---|---|---|---|---|---|---|
| | (1) | (2) | (3) | (4) | (5) | (6) | (7) | (8) | (9) | (10) |
| Storage stability *1 | o | o | o | o | o | o | o | x | o | x |
| Residue on sieve *2 (weight %) | (2.3%) | (3.1%) | (3.9%) | (3.3%) | (3.1%) | (2.9%) | (3.0%) | (5.3%) | (2.0%) | (6.0%) |

Remarks *1 refers to good stability upon storage. It was judged by the amount of the over size toners sieved by a 42 mesh screen being less than 5 weight % based on 10 gr. of the toners. Before sieving, 10 gr. of the toners were placed in a tightly closed bottle and maintained in a constant temperature bath set at 40° C. for 24 hours.
x refers to poor stability upon storage.

Compared with toners (8) to (10), which were prepared from binders C-8 to C-10 in the comparative examples, as the results of the above mentioned examples, the comparative examples and the examination showed that tones (1) to (7), which were prepared from binders C-1 to C-7 of the present invention, possessed a wider range of temperature between MF and HO while retaining presevability, i.e. they inhibited good stability upon long term storage, and exceeded in characteristics as toners.

What is claimed is:

1. A toner binder for electrophotography, comprising:

10 to 50% by weight of a thermoplastic resin (I) comprising a copolymer (I-a) whose molecular weight when fractionated by gel permeation chromatography is at least 30,000 and whose glass transition temperature is −20° to +40° C. and which has structural units of a styrene monomer and an acrylic or methacrylic monomer, and 50 to 90% by weight of a thermoplastic resin (II) comprising a polymer whose molecular weight when fractionated by gel permeation chromatography is less than 30,000 and whose glass transition temperature is +50° to +100° C. and which is a polymer selected from the group consisting of a (co)polymer (II-a) of a vinyl monomer selected from the group consisting of styrene and a substituted styrene, a copolymer (II-b) having structural units of a styrene monomer and an acrylic or methacrylic monomer, a polyester resin (II-c), and a copolymer (II-d) including a moiety of copolymer (II-b) and a moiety of polyester resin (II-c);

wherein said thermoplastic resin (I) and said thermoplastic resin (II) are selected to exhibit a difference of 25° to 100° C. between the respective glass transition temperatures thereof.

2. The toner binder for electrophotography according to claim 1, wherein said copolymer (I-a) consists of styrene and an acrylic ester.

3. The toner binder for electrophotography according to claim 1, wherein the content of said thermoplastic resin (I) is 15 to 45% by weight.

4. The toner binder for electrophotography according to claim 1, wherein said vinyl monomer constituting said thermoplastic resin (II) is styrene.

5. The toner binder for electrophotography according to claim 1, wherein said toner binder further comprises a polyolefin of 1,000 to 50,000 weight average molecular weight in an amount not exceeding 30% of the weight of said toner binder.

6. The toner binder for electrophotography according to claim 5, wherein said polyolefin is polypropylene of 3,000 to 40,000 weight average molecular weight.

7. The toner binder for electrophotography according to claim 1, wherein the absolute value of the complex viscosity coefficient at a temperature of 140° C. and a frequency of 10 rad./sec. is 1,000 to 20,000 poise, the storage modulus under the same conditions as the foregoing is 10,000 to 2000,000 dyn/cm$^2$, and the storage modulus at a temperature of 240° C. and a frequency of 10 rad.sec. is 100 to 4,000 dyn/cm$^2$.

8. The toner binder for electrophotography according to claim 2, wherein the absolute value of the complex viscosity coefficient at a temperature of 140° C. and a frequency of 10 rad./sec. is 1,000 to 20,000 poise, the storage modulus under the same conditions as the foregoing is 10,000 to 200,000 dyn/cm$^2$, and the storage modulus at a temperature of 240° C. and a frequency of 10 rad./sec. is 100 to 4,000 dyn/cm$^2$.

9. The toner binder for electrophotography according to claim 3, wherein the absolute value of the complex viscosity coefficient at a temperature of 140° C. and a frequency of 10 rad./sec. is 1,000 to 20,000 poise, the storage modulus under the same conditions as the foregoing is 10,000 to 200,000 dyn/cm$^2$, and the storage modulus at a temperature of 240° C. and a frequency of 10 rad./sec. is 100 to 4,000 dyn/cm$^2$.

10. The toner binder for electrophotography according to claim 4, wherein the absolute value of the complex viscosity coefficient at a temperature of 140° C. and a frequency of 10 rad./sec. is 1,000 to 20,000 poise, the storage modulus under the same conditions as the foregoing is 10,000 to 200,000 dyn/cm$^2$, and the storage modulus at a temperature of 240° C. and a frequency of 10 rad./sec. is 100 to 4,000 dyn/cm$^2$.

11. The toner binder for electrophotography according to claim 1, wherein said copolymer (I-a) has a glass transition temperature of −20° to +35° C.

12. The toner binder for electrophotography according to claim 1, wherein said styrene monomer of copolymer (I-a) is a member composed of monomers selected from the group consisting of styrene and substituted styrene.

13. The toner binder for electrophotography according to claim 12, wherein said substituted styrene is a member selected from the group consisting of an alkyl group substituted styrene and a halogen substituted styrene.

14. The toner binder for electrophotography according to claim 13, wherein said alkyl group substituted styrene is a member selected from the group consisting of α-methyl styrene and p-methyl styrene.

15. The toner binder for electrophotography according to claim 12, wherein said styrene monomer of copolymer (I-a) is composed of monomers of styrene.

16. The toner binder for electrophotography according to claim 1, wherein said methacrylic monomer of copolymer (I-a) is composed of monomers selected from the group consisting of acrylic acid, methacrylic acid, acrylonitrile, methacrylonitrile, an acrylic acid ester, and a methacrylic acid ester derived from an alcohol having one to eighteen carbon atoms.

17. The toner binder for electrophotography according to claim 16, wherein said alcohol contains a substituent selected from the group consisting of a hydroxyl group and an amino group.

18. The toner binder for electrophotography according to claim 16, wherein said methacrylic acid ester derived from an alcohol having one to eighteen carbon atoms is a member selected from the group consisting of a methyl (meth)acrylate, a (meth)-acrylate containing a hydroxyl group, and a (meth)-acrylate containing an amino group.

19. The toner binder for electrophotography according to claim 18, wherein said methyl methacrylate is a member selected from the group consisting of methyl (meth)acrylate, ethyl (meth)acrylate, butyl (meth)acrylate, 2-ethylhexyl (meth)acrylate, lauryl (meth)acrylate, and stearyl (meth)acrylate.

20. The toner binder for electrophotography according to claim 18, wherein said (meth)-acrylate containing a hydroxyl group is hydroxyethyl (meth)acrylate.

21. The toner binder for electrophotography according to claim 18, wherein said (meth)acrylate containing an amino group is a member selected from the group consisting of dimethylaminoethyl (meth)acrylate and diethylaminoethyl (meth)acrylate.

22. The toner binder for electrophotography according to claim 16, wherein said methacrylic monomer of copolymer (I-a) is composed of monomers selected from the group consisting of methacrylic acid and a methacrylic acid ester derived from an alcohol having one to eighteen carbon atoms.

23. The toner binder for electrophotography according to claim 22, wherein said methacrylic acid ester is a member selected from the group consisting of methyl (meth)acrylate, ethyl (meth)acrylate, butyl (meth)acrylate, and 2-ethylhexyl (meth)acrylate.

24. The toner binder for electrophotography according to claim 1, wherein said methacrylic monomer of copolymer (I-a) is composed of a mixture of monomers of methacrylic acid and methyl (meth)acrylate, ethyl (meth)acrylate, butyl (meth)acrylate, and 2-ethylhexyl (meth)acrylate.

25. The toner binder for electrophotography according to claim 1, wherein said copolymer (I-a) comprises a monomer selected from the group consisting of a vinyl ester, an aliphatic hydrocarbon vinyl monomer, and a multifunctional monomer having at least two or more double bonds that are capable of radical polymerization.

26. The toner binder for electrophotography according to claim 25, wherein said vinyl ester or said aliphatic hydrocarbon series vinyl monomer is present in an amount not exceeding 30 weight % of said copolymer (I-a).

27. The toner binder for electrophotography according to claim 25, wherein said multifunctional monomer having at least two or more double bonds that are capable of radical polymerization is present in an amount of less than 1 weight % of copolymer (I-a).

28. The toner binder for electrophotography according to claim 25, wherein said vinyl ester is a member selected from the group consisting of vinyl acetate and vinyl propionate.

29. The toner binder for electrophotography according to claim 25, wherein said aliphatic hydrocarbon vinyl monomer is butadiene.

30. The toner binder for electrophotography according to claim 25, wherein said multifunctional monomer having at least two or more double bonds that are capable of radical polymerization is a member selected from the group consisting of an aromatic multifunctional monomer and an aliphatic multifunctional monomer.

31. The toner binder for electrophotography according to claim 30, wherein said aromatic multifunctional monomer is divinyl benzene.

32. The toner binder for electrophotography according to claim 30, wherein said aliphatic multifunctional monomer is a member selected from the group consisting of ethylene glycol diacrylate and 1,6-hexanediol.

33. The toner binder for electrophotography according to claim 1, wherein said vinyl monomer of (co)polymer (II-a) is styrene.

34. The toner binder for electrophotography according to claim 1, wherein said substituted styrene of (co)polymer (II-a) is a member selected from the group consisting of an alkyl group substituted styrene and a halogen substituted styrene.

35. The toner binder for electrophotography according to claim 34, wherein said alkyl group substituted styrene is a member selected from the group consisting of α-methyl styrene and p-methyl styrene.

36. The toner binder for electrophotography according to claim 1, wherein said copolymer (II-b) is composed of structural units of a styrene monomer and an acrylic or methacrylic monomer, and wherein the types and proportions of said styrene monomer and said acrylic or methacrylic monomer result in copolymer (II-b) having a glass transition temperature between 50° and 100° C.

37. The toner binder for electrophotography according to claim 36, wherein said copolymer (II-b) is composed of styrene and (meth)acrylatic ester.

38. The toner binder for electrophotography according to claim 1, wherein said polyester resin (II-c) is a derivative of a dicarboxylic acid or an anhydride thereof having two to thirty carbon atoms, and a diol having two to thirty carbon atoms.

39. The toner binder for electrophotography according to claim 38, wherein said dicarboxylic acid, said anhydride thereof, and said diol are aliphatic or aromatic.

40. The toner binder for electrophotography according to claim 39, wherein said dicarboxylic acid and said anhydride thereof are aromatic.

41. The toner binder for electrophotography according to claim 40, wherein said aromatic dicarboxylic acid is a member selected from the group consisting of terephthalic acid, isophthalic acid, and phthalic acid.

42. The toner binder for electrophotography according to claim 40, wherein said aromatic anhydride is phthalic anhydride.

43. The toner binder for electrophotography according to claim 39, wherein said dicarboxylic acid and said anhydride thereof are aliphatic.

44. The toner binder for electrophotography according to claim 43, wherein said aliphatic dicarboxylic acid is a member selected from the group consisting of fumaric acid and maleic acid.

45. The toner binder for electrophotography according to claim 43, wherein said aliphatic anhydride is maleic anhydride.

46. The toner binder for electrophotography according to claim 39, wherein said diol is a member selected from the group consisting of bisphenol A ethylene oxide adduct, bisphenol A propylene oxide adduct, ethylene glycol, propylene glycol, and neopentyl glycol.

47. The toner binder for electrophotography according to claim 1, wherein said polyester resin (II-c) contains an aromatic group either on said dicarboxylic acid molecule or on said diol molecule.

48. The toner binder for electrophotography according to claim 1, wherein said polyester resin (II-c) has a bisphenol structure.

49. The toner binder for electrophotography according to claim 1, wherein said moiety of copolymer (II-b) and said moiety of polyester resin (II-c) of said copolymer (II-d) is either straight chained or branched.

50. The toner binder for electrophotography according to claim 1, wherein said copolymer (II-d) is a member selected from the group consisting of a condensation polymer of a copolymer moiety containing a carboxyl group composed of a styrene monomer and a (meth)acrylic monomer, and a polyester resin (II-c) moiety containing a hydroxyl group therein; a condensation polymer of a copolymer moiety containing a hydroxyl group composed of a styrene monomer and a (meth)acrylic monomer, and a polyester resin (II-c) moiety containing a carboxyl group therein; and an addition polymer of a polyester resin (II-c) having a radical polymerizable group and a monomer, so as to form a copolymer (II-a) moiety whose structural unit includes a styrene monomer and a (meth)acrylic monomer.

51. The toner binder for electrophotography according to claim 50, wherein said copolymer (II-d) is a graft-copolymer of a polyester resin (II-c) having a radical polymerizable group, and a monomer forming a copolymer (II-a) moiety whose structural unit includes a styrene monomer and a (meth)acrylic monomer.

52. The toner binder for electrophotography according to claim 1, wherein said copolymer (II-d) includes the same constitutes employed in said copolymer (I-a), said copolymer (II-b), and said polyester resin (II-c).

53. The toner binder for electrophotography according to claim 1, wherein said (co)polymer (II-a), said copolymer (II-b), said polyester resin (II-c), and said copolymer (II-d) of said thermoplastic resin (II) are employed alone or in a combination of two or more polymers.

54. The toner binder for electrophotography according to claim 1, wherein the content of said thermoplastic resin (II) is 55 to 85% by weight.

55. The toner binder for electrophotography according to claim 5, wherein said polyolefin is a member selected from the group consisting of polyethylene and polypropylene.

56. A toner for electrophotography, comprising 50 to 95 weight % of said toner binder of claim 1, 5 to 10 weight % of a colorant, 0 to 50 weight % of magnetic powder, a toner charge regulation agent, and an additive.

57. The toner for electrophotography according to claim 56, further comprising a fine powder of hydrophobic colloidal silica.

* * * * *